US005505634A

United States Patent [19]

Osten

[11] Patent Number: 5,505,634

[45] Date of Patent: Apr. 9, 1996

[54] CORD CONNECTOR

[76] Inventor: Frederick F. Osten, 11633 239th St. North, Scandia, Minn. 55073

[21] Appl. No.: 344,023

[22] Filed: Nov. 23, 1994

[51] Int. Cl.[6] ..... H01R 13/62

[52] U.S. Cl. ..... 439/369; 439/367

[58] Field of Search ..... 439/367, 369–371, 439/373

[56] References Cited

U.S. PATENT DOCUMENTS

| | | | |
|---|---|---|---|
| 3,029,408 | 4/1962 | Anderson . | |
| 3,193,309 | 7/1965 | Morris | 439/370 |
| 3,484,736 | 12/1969 | Wyse . | |
| 3,609,638 | 9/1971 | Darrey . | |
| 4,784,612 | 11/1988 | Ryan | 439/369 |
| 4,940,424 | 7/1990 | Odbert | 439/369 |
| 5,217,387 | 6/1993 | Hull et al. | 439/369 |
| 5,259,782 | 11/1993 | Giffin | 439/367 |
| 5,342,212 | 8/1994 | Francis | 439/369 |

*Primary Examiner*—Hien D. Vu

[57] ABSTRACT

An electrical cord connector for holding together a male electrical plug and a female electrical plug wherein the connector includes two one-piece receptacle-like members with their side walls forming conic threads such that the members may be threaded securely together to prevent the male and female electrical plugs from being pulled apart and if desired provide a water resistant environment for the male and female electrical plugs.

16 Claims, 1 Drawing Sheet

CORD CONNECTOR

FIELD OF THE INVENTION

This invention relates generally to an electrical cord connector for holding together a male electrical plug and a female electrical plug and, more specifically, to such a connector which protects the plugs against exposure to elements such as water and dirt.

BACKGROUND OF THE INVENTION

The male and female ends of mating electrical cords are held together by a friction fit. Such a connection is relatively loose and can be pulled apart if one pulls on the cords. The present invention provides apparatus for tightly securing the ends of mating electrical cords to each other and its particularly well suited for installation during manufacturing of the electrical cords but can also be installed on an after market basis by knowledgeable consumer. Furthermore, the connection is open to corrosion by water and dirt. The present invention is directed to an improved cord connector which not only provides for a relatively secure connection between two electrical cords, but also protects the male and female plugs and their respective prongs against exposure to elements such as water and dirt.

DESCRIPTION OF THE PRIOR ART

The Griffin U.S. Pat. No. 5,259,782 shows an electrical connector jacket that includes first and second housings for surrounding and holding the plug and receptacle. Each of the housings further includes two like halves that interlock with each other to surround the respective plug or receptacle.

The Odbert U.S. Pat. No. 4,949,424 shows an electrical plug accessory that includes two cylindrical members which engage one another with protuberances on one member sliding and latching in grooves in the other.

The Ryan U.S. Pat. No. 4,784,612 shows an electrical plug holder that includes a pair of hollow members each capable of accommodating a plug. The members each have an open end through which a plug can be accessed, and a substantially closed end, with a slot extending from the closed end to the open end, through which slot the electrical cord can be passed.

The Darrey U.S. Pat. No. 3,609,638 shows an extension cord coupling clamp that has a pair of spring-loaded, butterfly-type clamps which clamp on the core ends, the clamps being mounted on a threaded, roughened or serrated rod to thereby hold them against relative displacement.

The Wyse U.S. Pat. No. 3,484,736 shows a quick disconnector which has an automatic disconnect capability when a present tension is supplied to the connectors, such as when a small guided missile is to be fired from an aircraft or a booster rocket is to be detached and jettisoned during the launch of a space craft.

The Anderson U.S. Pat. No. 3,029,408 shows an extension cord clamp formed of two members of bent wire construction which cooperate with a channel-shaped clamp.

BRIEF SUMMARY OF THE INVENTION

Briefly, the present invention comprises a cord connector for holding together a male electrical plug and a female electrical plug. The cord connector includes first and second substantially hollow receptacle-like members, with each of the members having a side wall and a first end with an opening for circumferentially encompassing an electrical cord, and with each of the walls being shaped in the form of a thread so that an outside surface of each of the walls has a male thread and so that an inside surface of each of the walls has a female thread. One member is slightly smaller than the other to permit the members to be threadably engaged to each other.

DESCRIPTION OF THE PREFERRED EMBODIMENT

Figure 1:
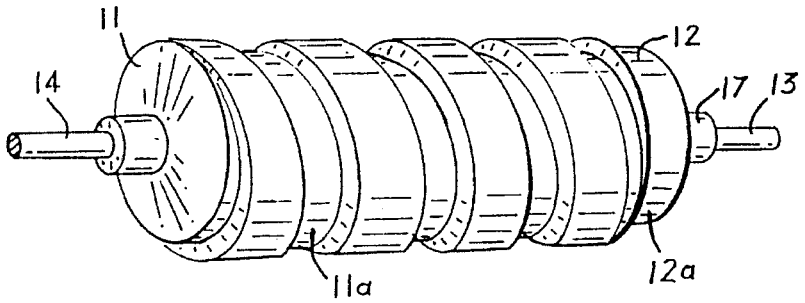
FIG. 1 shows a perspective view of the cord connector with electrical cord end portions extending from either end of the invention.

Referring to FIG. 1, reference numeral 10 generally identifies my cord connector. The connector 10 includes a one-piece female member 11 having a side wall 11*a* shaped in the form of a thread and being threadably engaged to a one-piece male member 12 having a side wall 12*a* which is also formed in the shape of a male thread. The outside surface of each of the side walls 11*a* and 12*a* is formed in the shape of a male thread, and the inside surface of each of the side walls 11*a* and 12*a* is formed in the shape of a female thread. Each of the members has a respective open end 11*c*, 12*c*. Each of the members 11, 12 is substantially hollow and forms receptacle-like member. Further, each of the members is, to the eye, substantially cylindrical. However, the side walls 11*a*, 12*a*, are actually slightly conical in shape.

Figure 4:
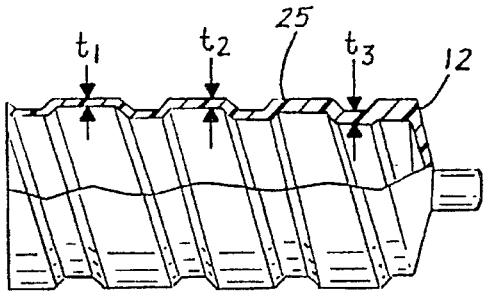
FIG. 4 shows a partially cut-away, section view of the cord connector.
Figure 3:
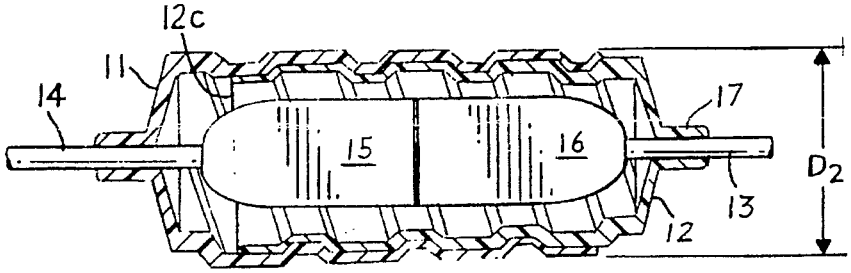
FIG. 3 shows a section view of the cord connector of FIG. 1.

Referring to FIGS. 1,3, and 4, an end portion 13 of a first electrical cord extends into the male member 12 and an end portion 14 of a second electrical cord extends into the female member 11. The electrical cord end portion 14 is affixed to a female electrical plug 15 and the electrical cord end portion 13 is affixed to a male electrical plug 16. The male electrical plug 16 includes electrical prongs 16*a* for mating with the female electrical plug 15.

More particularly with reference to FIG. 1, each of the members 11, 12 includes a nipple seal or water resistant end extension 17 integrally connected, such as by molding, to a first end of each of the members, 11, 12 for circumferentially encompassing the respective electrical cord portions 13, 14. Each of the nipple seals 17 includes an opening 18 to permit its respective cord portion to pass therethrough. Each of the openings 18 is of a sufficiently great diameter to permit its respective cord portion to slide relatively easily therethrough, but are of a sufficiently small diameter to seal the interior of the connector 10 against the entry of water and fine particles such as dirt and sand. There is some friction between the nipple seals 17 and their respective cord portions 13, 14 as the cord portions 13, 14 engage the nipple seals 17.

Further, the openings 18 are of sufficiently small diameters to prevent the plugs 15, 16, from slipping therethrough. If one of both of the cord portions 13, 14, are pulled in opposite directions, one or both of the plugs 15, 16 may engage the inner surface of an end or end wall 19 of the members 11, 12. It should be noted that my cord connector 10 is a pre-market device intended for OEM manufacturers so that the consumer is less likely to engage in the dangerous practice of splicing existing electrical cords to adapt such cords to fit my connector 10, a practice which may defeat the purpose of my invention as a splice may weaken the electrical cord. However, my invention is also suited for those industrial users who wish to remove the male and female plug and then reattach them to the cord after the cord connectors are mounted on the cord.

Figure 2:
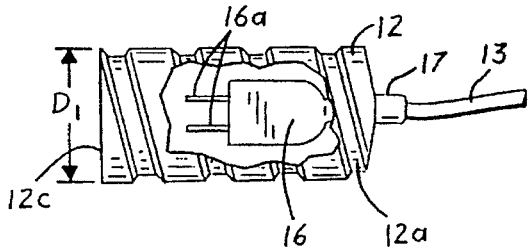
FIG. 2 shows a partially cut-away view of the cord connector.

Male member 12 is smaller than female member 11. This is shown by reference to FIGS. 3 and 4. The open end 12*c* of the male member 12 may be defined as having an outer diameter, $D_1$, as shown in FIG. 2. As shown in FIG. 3, the open end 11*c* of the female member 11 may be defined as having an inner diameter, $D_2$. In their unengaged positions, $D_1$ of the male member is less than $D_2$ of the female member to permit the members to be threadably engagable.

Referring to FIG. 4, the side wall 12*a* of male member 12 gradually decreases in thickness from its end wall 19 to its open end 12*c*. This tapering is shown by the reference symbols $t_1$, $t_2$, $t_3$, which identify the thickness of the side wall 12*a* at three different circumferential portions $t_3$ is greater than $t_2$ which in turn is greater than $t_1$. $t_3$ may be about 0.090 inches. $t_1$ may be about 0.075 inches. $t_2$ is typically somewhere between these two values. This tapering aids in permitting a tight, water resistant connection between the male and female members. It should be noted that female member 11, including the tapering side wall, is substantially identical to the male member 12 except that the female member is slightly larger in diameter than the male member 12.

Referring to FIG. 4, the thread 24 of the side wall 12 of male member 12 may be identified by reference to a flat crest 25 and a flat root 26. The sides 27 of the crest 25 are beveled.

The thread 24 of the side walls 11*a*, 12*a* is conical. The conical thread 24 aids in providing for a tight water resistant fit between the members 11, 12 because the farther the members 11 and 12 are threaded together the tighter the connection between the two members. It should be noted here that, as mentioned above, the side walls 11*a*, 12*a* are cylindrical to the human eye. However, the side walls 11*a*, 12*a* are slightly conical to provide for the necessary engagement to produce the water resistant fit.

The width of the crest 25 is about the width of an adult's finger to permit the fingers of the hand to ergonomically engage the beveled crest sides 27 and the root 26. The threaded side walls thus may be firmly gripped and readily tightened relative to each other.

In operation, the female and male members 11, 12 are slid onto an electrical cord to which female and male plugs 15, 16 have yet to be connected as the electrical cord may be in the process of being fabricated such as by an OEM. Fabrication of the electrical cord may then be completed by attaching the female and male plugs 15, 16 such that the female member 11 may be positioned over the female plug 15 and such that the male member 12 may be positioned over the male plug 16.

Two like electrical cords are thus mateable to each other. First, the female and male plugs 15 and 16 are connected. Then the female and male members 11, 12 are slid along their respective electrical cords until they touch one another whereupon they may be screwed together relatively tightly. Since the members 11, 12 are conical, tapering slightly from their end walls 19 to their respective open end 11*c* or 12*c*, an increasingly greater seal is formed as the members 11, 12 are screwed together. Such provides a water resistant seal. To disconnect the respective electrical cords, the operation is reversed.

It should be noted that the female and male members 11, 12 may be described as being formed in the shape of a receptacle or as being receptacle-like as each of the members 11, 12 have an end wall, a side wall, and an open end.

I claim:

1. An electrical cord connector for holding together a male electrical plug connected to a first electrical cord and a female electrical plug connected to a second electrical cord, comprising:

a first substantially hollow receptacle-like member, said first member having a side wall and a first end with an opening therein for circumferentially encompassing the first electrical cord and said side wall being positionable over the male electrical plug thereon, said side wall shaped in the form of a thread so that an outside surface of said side wall has a male thread in the form of a plurality of partial conical shapes so that an inside surface of said side wall has a female thread in the form of a plurality of partial conical shapes; and a second substantially hollow receptacle-like member, said second member having a side wall and a first end with an opening therein for circumferentially encompassing the second electrical cord and said side wall being positionable over the female electrical plug thereon, said second member substantially identical to said first member except that the second member is larger than said first hollow member to permit threading said second member onto said first member to thereby prevent disengagement of the male and female connectors located in the respective first and second members, said second member having a tapering side wall with a thickness of said tapering side wall on said second member decreasing from said first end of said second member to an opposite end of said second member so that when said first member is threaded onto said second member the tapering side wall aids in causing said first member and said second member to from a tight water resistance connection between the two members and to prevent disengagement of the two members.

2. The cord connector of claim 1 wherein the thickness of the side wall of the first member decreases from the first end of the first hollow member.

3. The cord connector of claim 1 wherein said second hollow receptacle-like member and said first hollow receptacle-like member are made of PVC.

4. The cord connector of claim 1 wherein the threads on said first member is molded in said side wall.

5. The cord connector of claim 1 wherein said first and second members each include an end extension for forming a water resistant connection around each of the electrical cords extending through each of said extensions.

6. The cord connector of claim 1 wherein said first member and said second member are secured to each other in a water resistant connection.

7. The cord connector of claim 1 wherein said first member is one piece.

8. The cord connector of claim 1 wherein said threads have a flat root and a flat crest.

9. The cord connector of claim 1 wherein the side wall is resilient such that it is squeezable by the hand.

10. The cord connector of claim 1 wherein said first hollow receptacle-like member includes a nipple seal and said second hollow receptacle-like member includes a nipple seal to retard moisture from entering said hollow receptacle-like members.

11. The cord connector of claim 10 wherein said first hollow receptacle-like member and said second hollow receptacle-like member coact to retard moisture from entering into a cavity formed by said receptacle-like members.

12. An electrical cord connector for holding together a male electrical plug on a first electrical cord and a female electrical plug on a second electrical cord, comprising:

a first substantially hollow receptacle-like member, said first member having a side wall and a first end with an opening therein for circumferentially encompassing the first electrical cord and said side wall being positionable over the male electrical plug thereon, said side wall shaped in the form of a thread so that an outside surface of said side wall has a male thread and so that an inside surface of said side wall has a female thread and wherein each of said threads have root portions and crest portions, the crest portions having a width about the width of an adult's finger whereby the members may be easily gripped by the hand; and a second substantially hollow receptacle-like member, said second member having a side wall and a first end with an opening therein for circumferentially encompassing the second electrical cord and said side wall being positionable over the female electrical plug thereon, said second member substantially identical to said first member except that the second member is larger than said first hollow member to permit threading said second member onto said first member in tight engagement to thereby prevent disengagement of the male and female plugs located in the respective first and second members.

13. An electrical cord assembly, comprising:

a pair of electrical cords for carrying electricity and each of said cords having an end to be connected with a male electrical plug or a female electrical plug;

a first substantially hollow receptacle member, said first member having a side wall and a first end with an opening therein for circumferentially encompassing one of the respective cord ends and said side wall being positionable over the male electrical connector thereon, said wall shaped in the form of a thread so that an outside surface of said side wall has a male thread with partial conic shaped portions and so that an inside surface of said side wall has a female thread with partial conic shaped portions; and a second substantially hollow receptacle member, said second member having a first end with an opening therein for circumferentially encompassing one of the respective cord ends and a side wall being positionable over the female electrical connector thereon, said second member substantially identical to said first member except that the second member is larger than said first member to permit threading said second member onto said first member to thereby form a tight water resistant sealing engagement and to prevent disengagement of the male and female connectors located in the respective first and second members.

14. The electrical cord assembly of claim 13 wherein each of the members is formed in a shape of portions of a cone so that each of the side walls tapers from a respective end such that when the members are threaded together an increasingly greater seal is formed.

15. The electrical cord assembly of claim 13 wherein each of the members is formed in a shape that appears cylindrical to the eye.

16. A connector assembly comprising:

a male connector comprising a first substantially hollow receptacle-like member for encompassing a male electrical plug, said first member having a side wall and a first end, said wall shaped in the form of a thread so that an outside surface of said side wall has a male thread with partial conic shaped portions so that an inside surface of said side wall has a female thread with partial conic shaped portions; and a female connector comprising a second substantially hollow receptacle-like member for encompassing a female electrical plug, said second member having a first end, said second member substantially identical to said first member except that the second member is larger than said first hollow member to permit threading said second member onto said first member to thereby prevent disengagement of the male and female connectors, said second member having a tapering side wall so that a thickness along said side wall on said second member decreases from said first end of said second member to an opposite end of said second member so that when said first member is threaded onto said second member the tapering side wall aids in causing said first member and said second member to form a water resistant connection between the two members as the first member is threaded onto the second member.

* * * * *